US007607515B2

(12) United States Patent
Wang

(10) Patent No.: US 7,607,515 B2
(45) Date of Patent: Oct. 27, 2009

(54) ELEVATOR EVACUATION APPARATUS

(76) Inventor: Chiu Nan Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 86 days.

(21) Appl. No.: 11/880,277

(22) Filed: Jul. 20, 2007

(65) Prior Publication Data

US 2009/0020371 A1 Jan. 22, 2009

(51) Int. Cl.
*B66B 11/08* (2006.01)
*B66B 13/14* (2006.01)

(52) U.S. Cl. ..... 187/263; 187/314

(58) Field of Classification Search ..... 187/263, 187/290, 298, 306, 309, 310, 312, 314; *B66B 5/02*
See application file for complete search history.

(56) References Cited

U.S. PATENT DOCUMENTS 2,265,891 A * 12/1941 Valdemar ..... 192/223.1
5,680,911 A * 10/1997 Wang ..... 187/263
5,713,433 A * 2/1998 Wang ..... 187/263
5,890,565 A * 4/1999 Wang ..... 187/263
6,116,380 A * 9/2000 Wang ..... 187/263
6,516,921 B1 * 2/2003 Wang ..... 187/263
6,557,670 B2 * 5/2003 Wang ..... 187/290
2007/0170409 A1 * 7/2007 Ito ..... 254/375
2008/0078627 A1 * 4/2008 Wang ..... 187/314

FOREIGN PATENT DOCUMENTS

DE 3419443 A1 * 11/1985

* cited by examiner

*Primary Examiner*—John Q. Nguyen
*Assistant Examiner*—Stefan Kruer
(74) *Attorney, Agent, or Firm*—Pro-Techtor Int'l Services; Ralph Willgohs

(57) ABSTRACT

An elevator evacuation apparatus is described, which enables a person(s) trapped in a stopped elevator car to pull a emergency cable outside a car window to activate a cam based pulley and gear mechanism which in turn intermittently releases and actuates a brake, thereby slowly lowering the stopped car until arriving at a correct floor. A number of embodiments are possible.

6 Claims, 10 Drawing Sheets

ELEVATOR EVACUATION APPARATUS

BACKGROUND OF THE INVENTION

1. Field of Invention

The invention relates to apparatus for enabling person(s) trapped in a stopped elevator car to evacuate safely, and more particularly to such an elevator evacuation apparatus with improved characteristics.

2. Description of Related Art

Components of a first conventional elevator evacuation arrangement mounted in a machine room (not shown) are shown in FIG. 1 and comprise a motor 1, a drive sheave 2 driven by the motor 1, a plurality of parallel ropes 3 run through rope grooves of the drive sheave 2, the ropes 3 having one ends connected to a top of an elevator car (not shown) and the other ends connected to a counterweight (not shown), and a brake 4 mechanically connected to the motor 1. The brake 4 is adapted to actuate to stop the rotation of the drive sheave 2 in case of emergency (e.g., power outage).

Components of the first conventional elevator evacuation arrangement further comprise a lever 5 having a shaft 5*a*, and a cam 6. Typically, a skilled mechanic is called to enter the machine room to manually push the lever 5 to actuate the cam 6 via the shaft 5*a*. The cam 6 in turn presses down a member (e.g., plunger) to release the brake 4. Thereafter, the drive sheave 2 is able to rotate again for lowering the car to a next floor since it is typical that the car did not stop at the correct floor location when the emergency occurred. Eventually, person(s) trapped in the car can evacuate safely.

The first conventional elevator evacuation arrangement has the following disadvantages. For example, it requires calling a skilled mechanic to come to the site for troubleshooting. This inevitably will delay the precious saving time and it is highly undesirable. Moreover, a successful evacuation depends on the unbalanced state (i.e., weight of the counterweight being not equal to that of the stopped car so that the car is capable of lowering in response to releasing the brake 4). Hence, the skilled mechanic is useless if the car is in a balanced state.

A second conventional elevator evacuation arrangement is shown in FIG. 2 in which a rod 7*a* is extended out of a member (e.g., plunger) of a brake 7 and a spring 7*b* is put on shank of the rod 7*a*. A skilled mechanic has to press the spring depressible rod 7*a* to release the brake 7 via the plunger in the troubleshooting procedure. The second conventional elevator evacuation arrangement also has the disadvantage of requiring a skilled mechanic to come to the site for troubleshooting.

A third conventional elevator evacuation arrangement is shown in FIG. 3 in which a disc brake is provided between a drive sheave 2 and a motor 1, and the brake comprises brake pads 8*a* and a disc 8. In operation, a skilled mechanic may manually push a lever 8*b* to actuate the brake pads 8*a*. The brake pads 8*a* in turn urge against the disc 8 to release the brake. The third conventional elevator evacuation arrangement still has the disadvantage of requiring a skilled mechanic to come to the site for troubleshooting.

There have been numerous suggestions in prior patents for enabling person(s) trapped in a stopped elevator car to evacuate safely. For example, U.S. Pat. No. 6,739,431 discloses an elevator escape device. Thus, continuing improvements in the exploitation of elevator evacuation apparatus are constantly being sought.

SUMMARY OF THE INVENTION

It is therefore one object of the invention to provide an apparatus for enabling person(s) trapped in a stopped elevator car to pull an emergency cable outside a car window to activate a cam based pulley and gear mechanism which in turn intermittently releases and actuates a brake, thereby slowly lowering a stopped car until arriving a correct floor.

The above and other objects, features and advantages of the invention will become apparent from the following detailed description taken with the accompanying drawings.

DETAILED DESCRIPTION OF THE INVENTION

Figure 1:
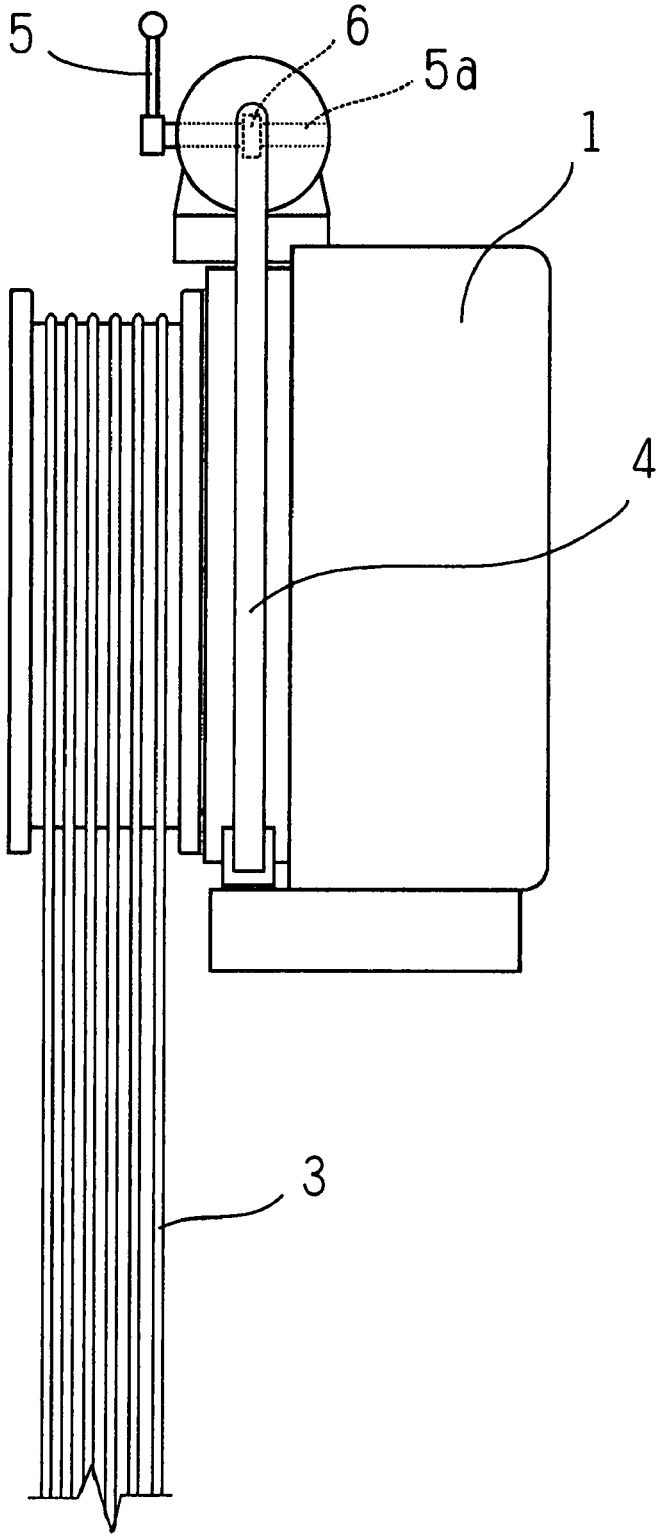
FIG. 1 is a schematic side view of a first conventional elevator evacuation arrangement.
Figure 2:
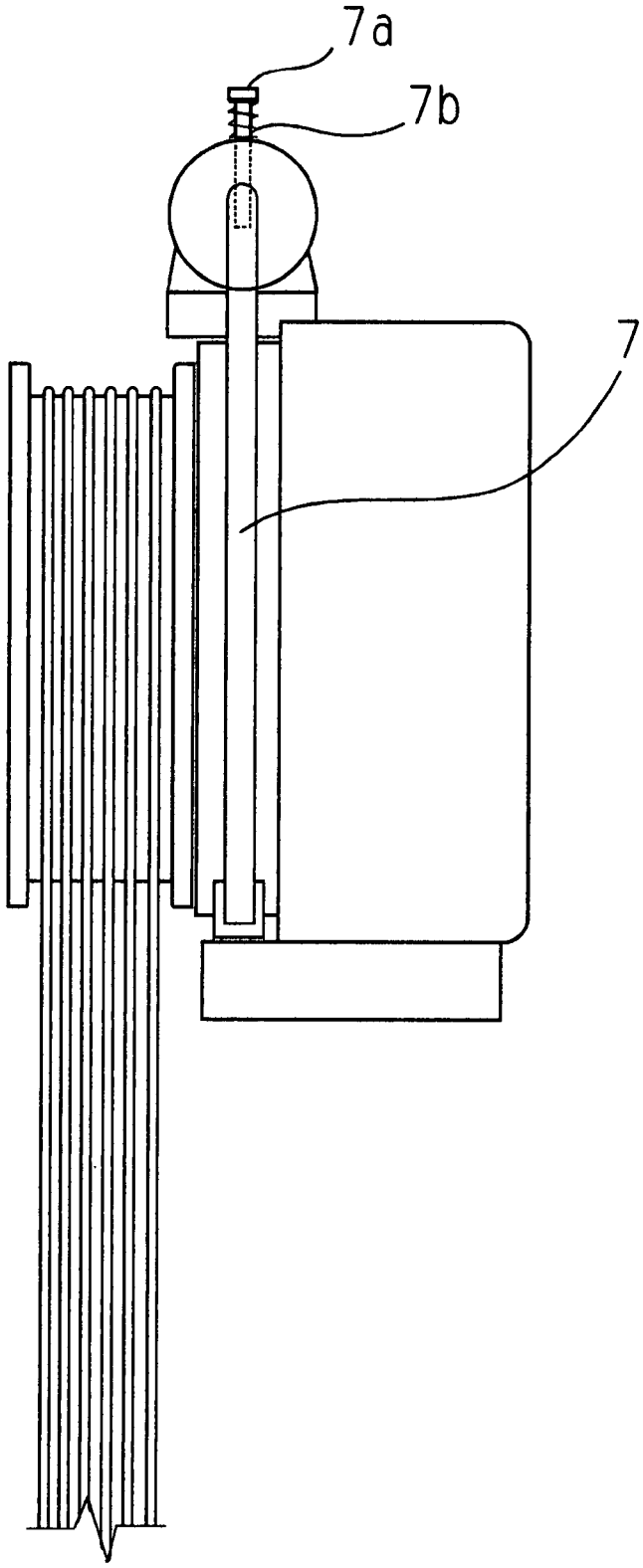
FIG. 2 is a schematic side view of a second conventional elevator evacuation arrangement.
Figure 3:
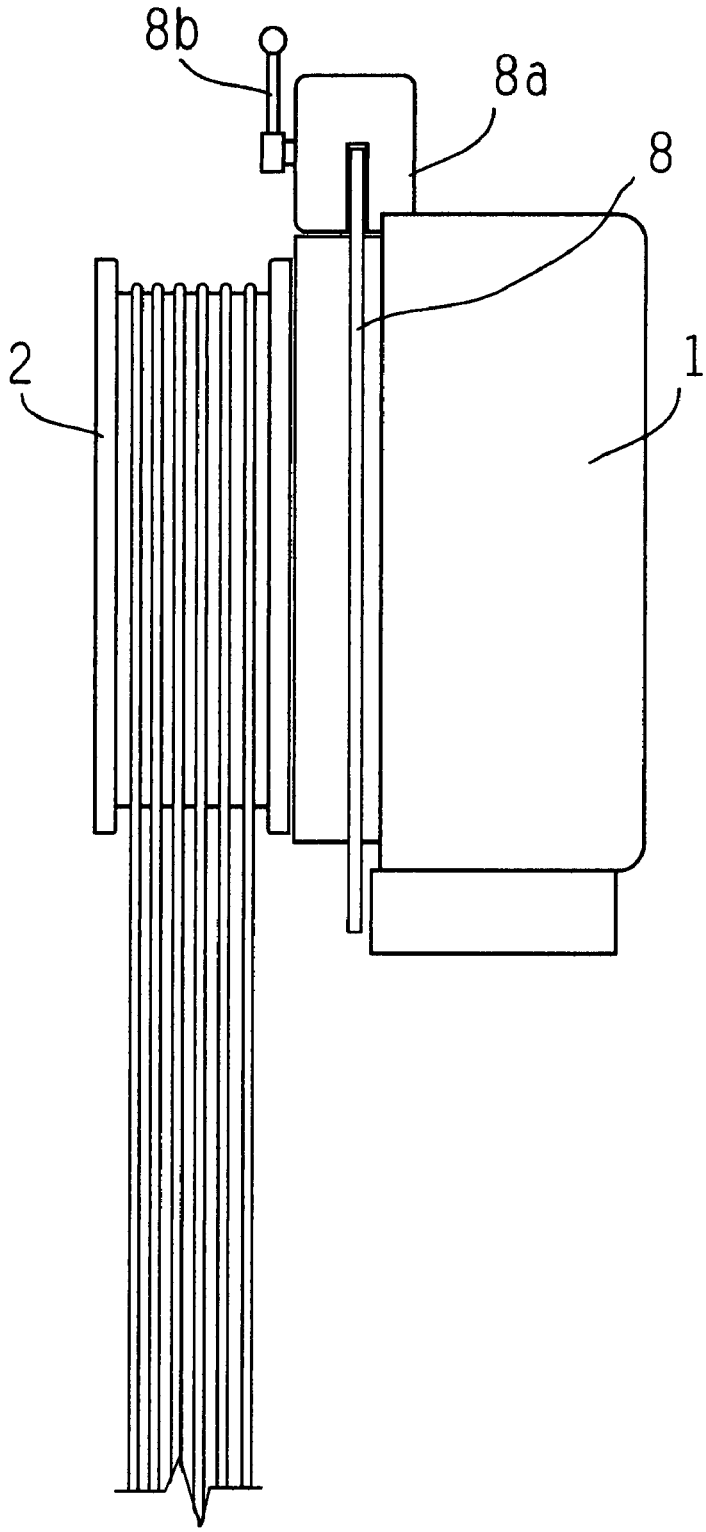
FIG. 3 is a schematic side view of a third conventional elevator evacuation arrangement.
Figure 4:
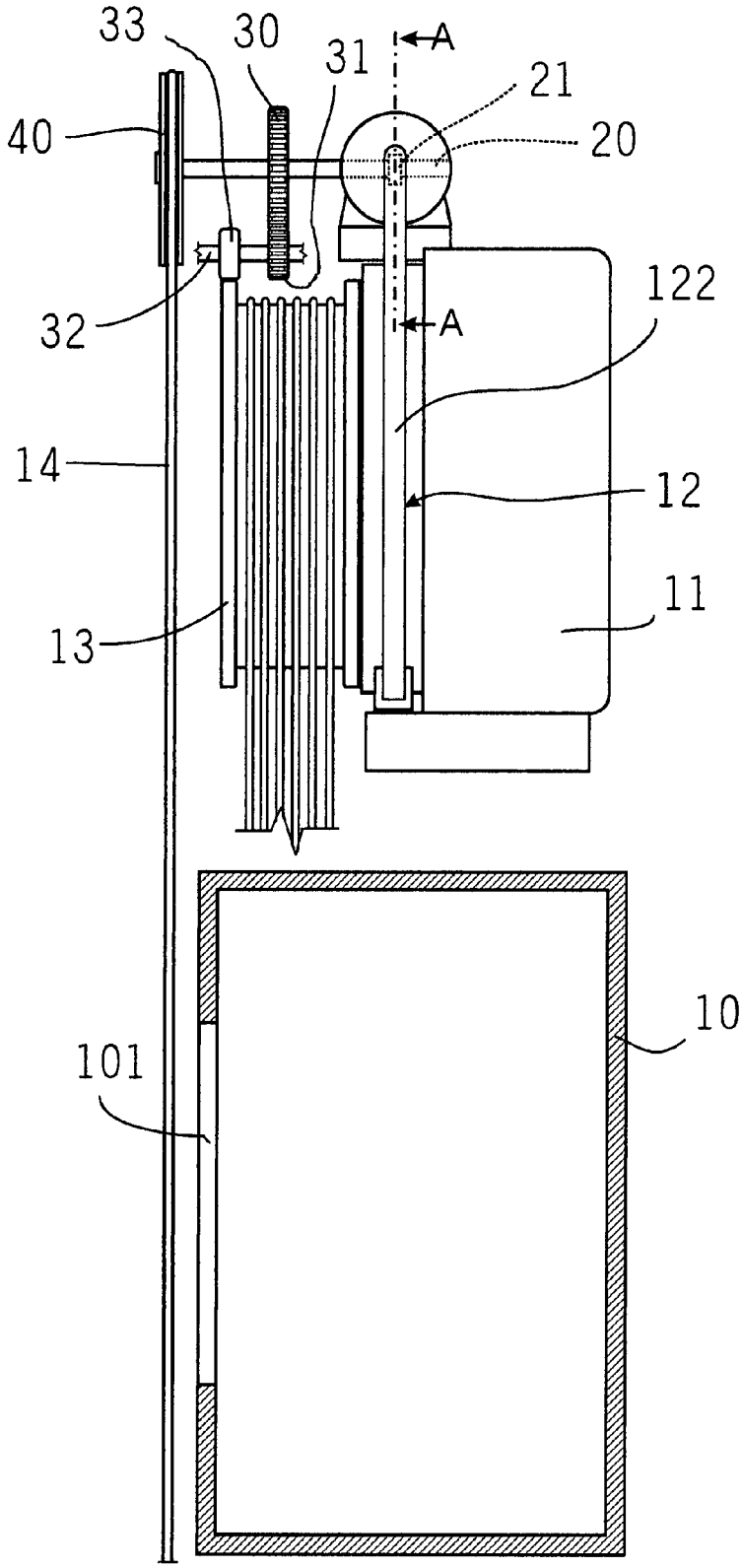
FIG. 4 is a schematic side view of a first preferred embodiment of elevator evacuation apparatus according to the invention.

Referring to FIGS. 4 to 11 an elevator evacuation apparatus in accordance with a first preferred embodiment of the invention is shown. The apparatus is mounted in a machine room (not shown) and comprises a motor 11, a drive sheave 13 driven by the motor 11, a brake 12 mechanically connected to the motor 11 and provided between the drive sheave 13 and the motor 11. The evacuation apparatus includes an intermittent brake release mechanism and an auxilliary drive for urging the drive sheave in an emergency when the brake is released.

The brake 12 comprises a brake operating device, which in one embodiment has two opposite plungers 121 and a brake shoe 122 connected to both the plungers 121. The intermittent brake release mechanism has a first shaft 20 that is provided externally of the motor 11 and comprises a first cam 21 formed therearound. The first cam 21 is provided between the plungers 121 and spaced therefrom in its inoperative position (see FIG. 5). A proximal first gear 30 and a distal emergency pulley 40 are coaxially provided on the first shaft 20. The auxilliaiy drive has a second gear 31 that is in mesh with the first gear 30. A second cam 33 is spaced from the second gear 31 and a second shaft 32 passes both the second cam 33 and the second gear 31 so that the second cam 33 and the second gear 31 can rotate coaxially with respect to the second shaft 32. The second cam 33 in turn is adapted to intermittently engage with the rim of the drive sheave 13 as detailed later. An emergency cable 14 runs through the grooved rim of the emergency pulley 40 to pass down and dispose externally of a window 101 of a car 10.

In response to a stop of the elevator in case of emergency (e.g., due to power outage), the brake shoe 122 actuates to stop the rotation of the drive sheave 13. Also, the car 10 does not stop at the correct floor location. Hence, a person trapped in the car 10 has to reach his or her hand out of the window 101 to hold and pull down the emergency cable 14. As a result, the emergency pulley 40 turns and thus both the first shaft 20 and the first gear 30 turn. At the same time, the first cam 21 turns to alternatingly release the brake 5 shoe 122, by pushing the plungers 121 further away from each other at one time, and to actuate the brake shoe 122 by disengaging from the plungers 121 with the plungers 121 returning to their inoperative positions at a subsequent time. That is, the brake shoe 122 releases and actuates intermittently. Also, the second gear 31 turns in a direction opposing that of the first gear 30 and the second cam 33 turns the same direction as the second gear 31. As a result, the second cam 33 intermittently turns the drive sheave 13. Therefore, the car 10, conneded to one ends of hoist ropes (not numbered), lowers on the hoist ropes run through rope grooves of the drive sheave 13 and by a passenger pulling down on the emergency cable 14 causing a rotation of the drive sheave 13 aided by the difference in weight of a counterweight (not numbered) if unequal to that of the stopped car 10 (i.e., as when the car 10 is in its unbalanced state). The trapped person can stop the pulling when the car 10 has arrived at the correct floor. Eventually, person(s) trapped in the car 10 can evacuate safely.

Figure 5:
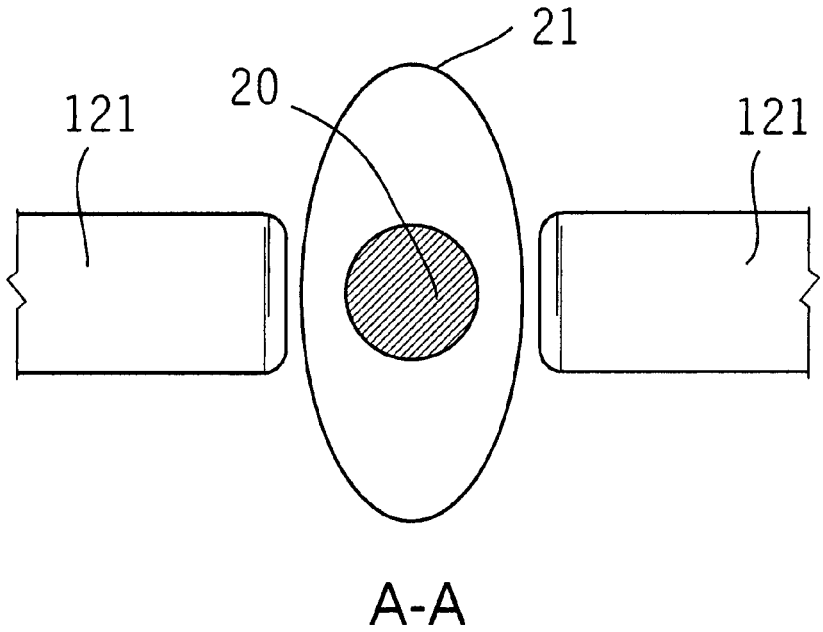
FIG. 5 is a sectional view taken along line A-A of FIG. 4 where a first configuration of the first cam according to the invention is shown in its inoperative position.

As shown in FIG. 5, the first cam 21 has a section of oval. Distance between ends of the plungers 121 is a minimum when short axis of the first cam 21 is aligned with the plungers 121 and the first cam 21 does not contact the plungers 121. At this position, the brake shoe 122 is actuated.

Figure 6:
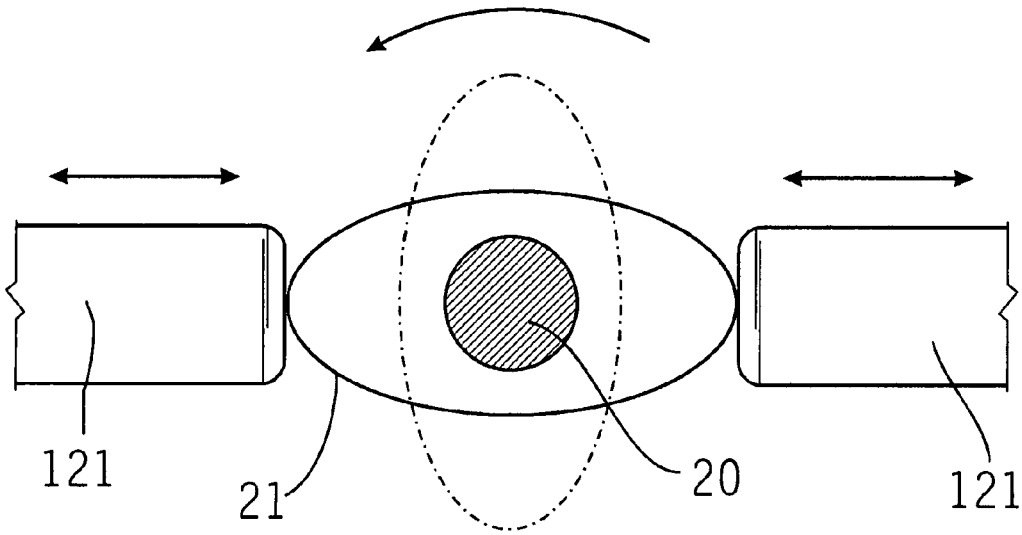
FIG. 6 is a view similar to FIG. 5 where the first cam is operating.

As shown in FIG. 6, the first cam 21 turns clockwise as indicated by arrow in response to turning the first shaft 20. Distance between the ends of the plungers 121 is a maximum when long axis of the first cam 21 is aligned with the plungers 121 and the first cam 21 contacts the plungers 121 by pushing them further away from each other (see arrows). At this position, the brake shoe 122 is released. Moreover, the weight of the counterweight is not unequal to that of the stopped car 10 (i.e., the car 10 is in its unbalanced state). As a result, the drive sheave 13 turns to lower the car 10.

Figure 7:
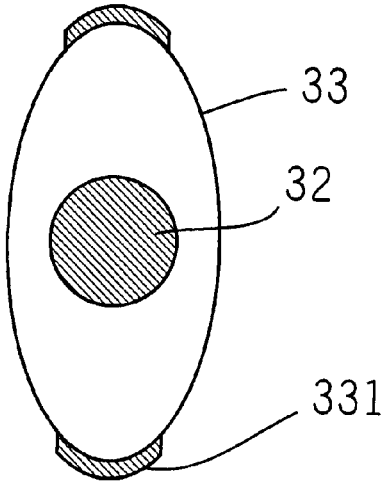
FIG. 7 is a schematic sectional view of a first configuration of the second cam according to the invention.

As shown in FIG. 7, a first configuration of the second cam 33 has a raised member 331 on either end of its long axis. The raised members 331 are adapted to contact the rim of the drive sheave 13 or not during the car lowering operation.

Figure 10:
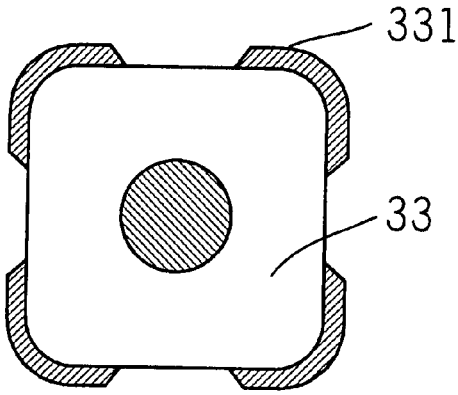
FIG. 10 is a schematic sectional view of a second configuration of the second cam according to the invention.

As shown in FIG. 10, a second configuration of the second cam 33 has a section of square and four raised members 331 on four corners.

Figure 11:
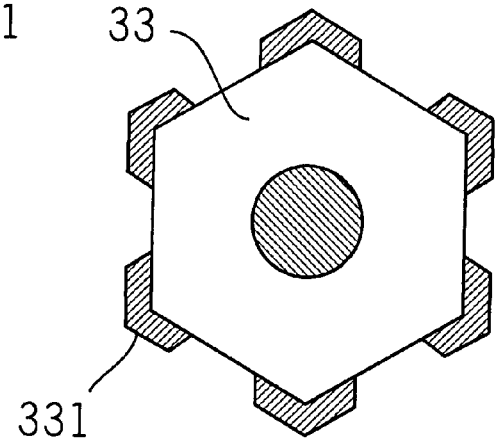
FIG. 11 is a schematic sectional view of a third configuration of the second cam according to the invention.

As shown in FIG. 11, a third configuration of the second cam 33 has a section of hexagon and six raised members 331 on six angles.

Preferably, the raised members 331 are pads.

Figure 8:
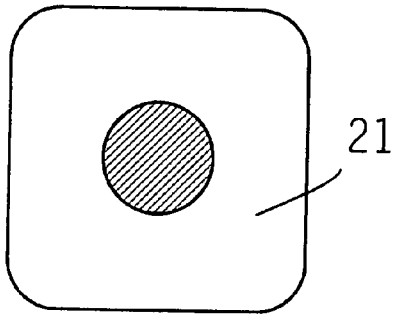
FIG. 8 is a schematic sectional view of a first configuration of the first cam according to the invention.
Figure 9:
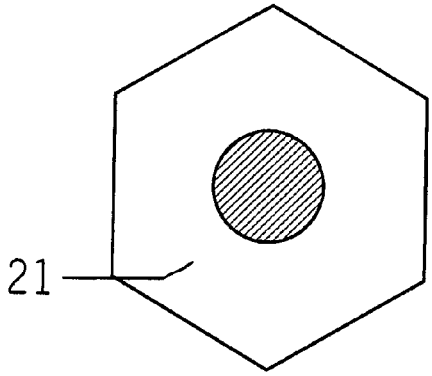
FIG. 9 is a schematic sectional view of a second configuration of the first cam according to the invention.

As shown in FIG. 8, a first configuration of the first cam 21 has a section of square. As shown in FIG. 9, a second configuration of the first cam 21 has a section of hexagon.

Figure 12:
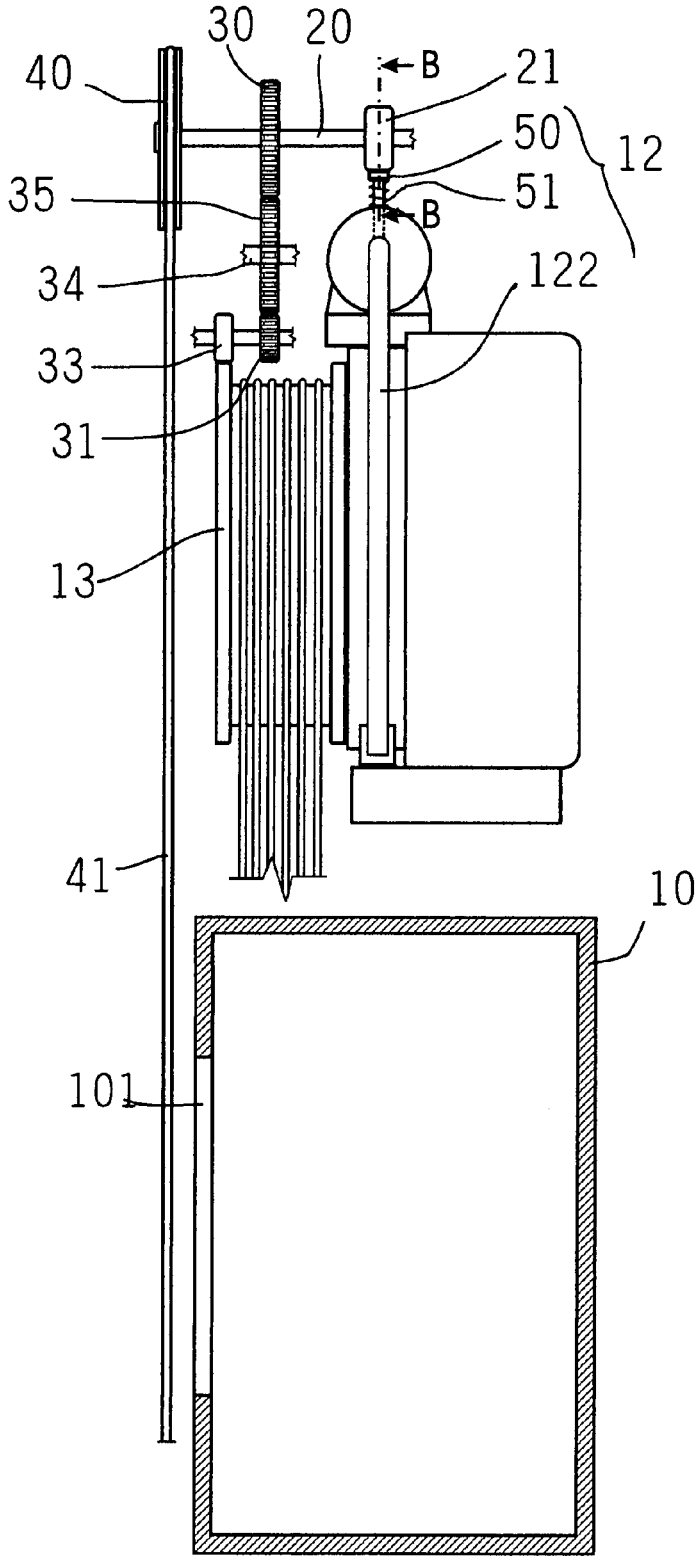
FIG. 12 is a schematic side view of a second preferred embodiment of elevator evacuation apparatus according to the invention.
Figure 13:
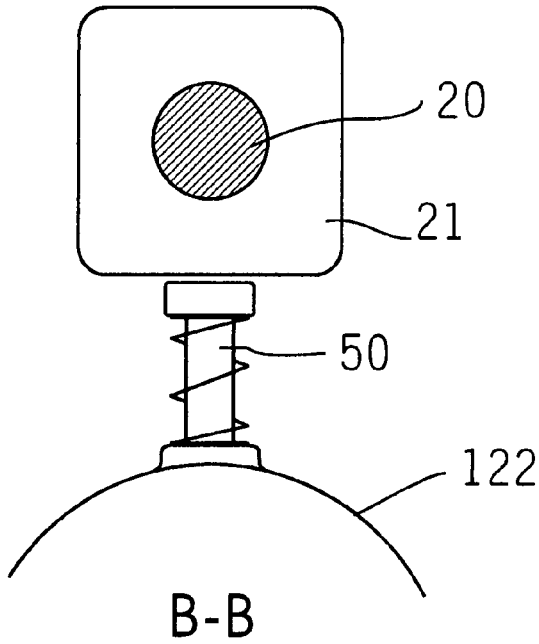
FIG. 13 is a sectional view taken along line B-B of FIG. 12 where the rod according to the invention is shown in its inoperative position.
Figure 14:
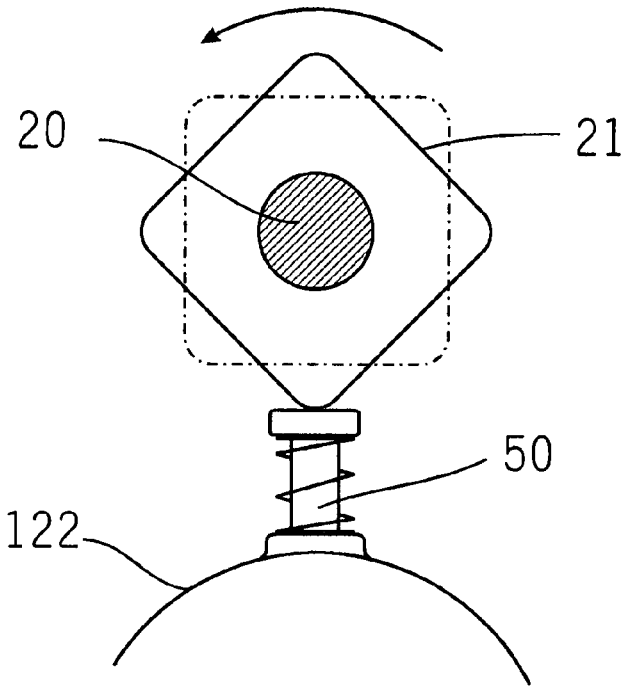
FIG. 14 is a view similar to FIG. 13 where the rod is operating.

Referring to FIGS. 12 to 14 an elevator evacuation apparatus in accordance with a second preferred embodiment of the invention is shown. The characteristics of the second preferred embodiment are detailed below. An idler gear 35 turning on its shaft 34 is provided between the second gear 31 and the first gear 30 and is in mesh with the both. The first cam 21 has a section of square and is adapted to turn on the first shaft 20. A rod 50 is extended out of the brake shoe 122 and a spring 51 is put on shank of the rod 50. The rod 50 is in close proximity to one side of the first cam 21 but does not contact it. That is, the brake shoe 122 is released in a normal operation of the elevator. The brake shoe 122 actuates to stop the rotation of the drive sheave 13 in case of emergency (e.g., due to power outage). Also, the car 10 does not stop at the correct floor location. Hence, a person trapped in the car 10 can reach his or her hand out of the window 101 to hold and pull down the emergency cable 14. As a result, the emergency pulley 40 turns and thus both the first shaft 20 and the first gear 30 turn. At the same time, the first cam 21 turns to release the brake shoe 122 by pressing the rod 50 in one time and actuate the brake shoe 122 by disengaging with the rod 50 in an immediately next time. That is, the brake shoe 122 releases and actuates intermittently. Also, the second gear 31 turns in a direction the same as that of the first gear 30 via the meshed idler gear 35. Also, the second cam 33 turns the same direction as the second gear 31. As a result, the second cam 33 intermittently turns the drive sheave 13. Therefore, the car 10, connected to one ends of the hoist ropes, lowers by pulling down the hoist ropes run through the rope grooves of the drive sheave 13 and by causing weight of the counterweight to be unequal to that of the stopped car 10 (i.e., the car 10 is in its, unbalanced state). The trapped person can stop the pulling when the car 10 has arrived the correct floor. Eventually, person(s) trapped in the car 10 can evacuate safely.

Figure 15:
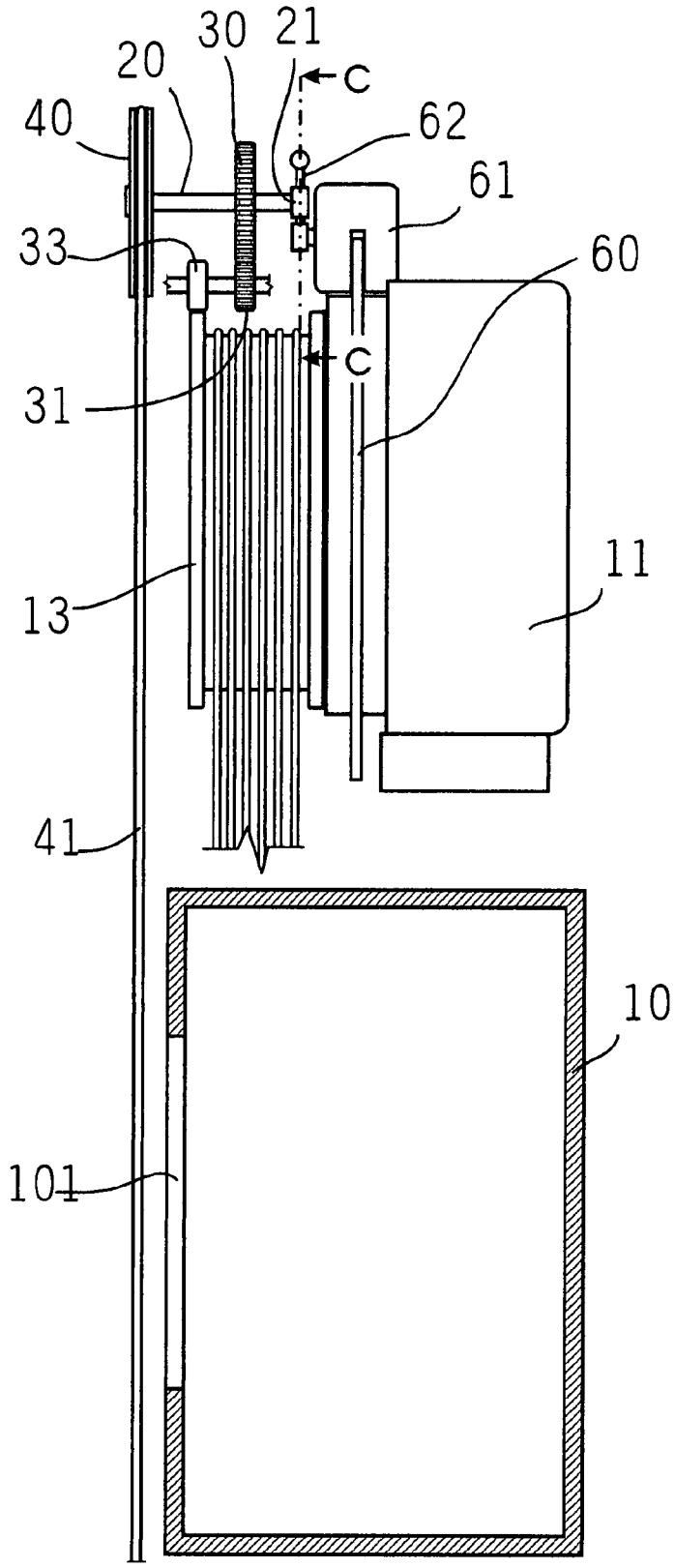
FIG. 15 is a schematic side view of a third preferred embodiment of elevator evacuation apparatus according to the invention.
Figure 16:
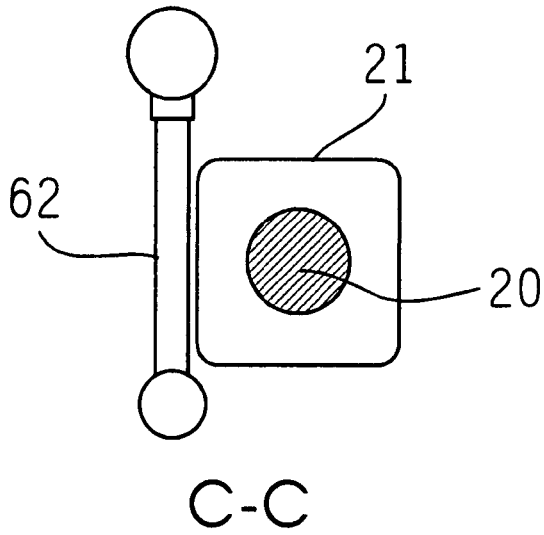
FIG. 16 is a sectional view taken along line C-C of FIG. 15 where the lever according to the invention is shown in its inoperative position.
Figure 17:
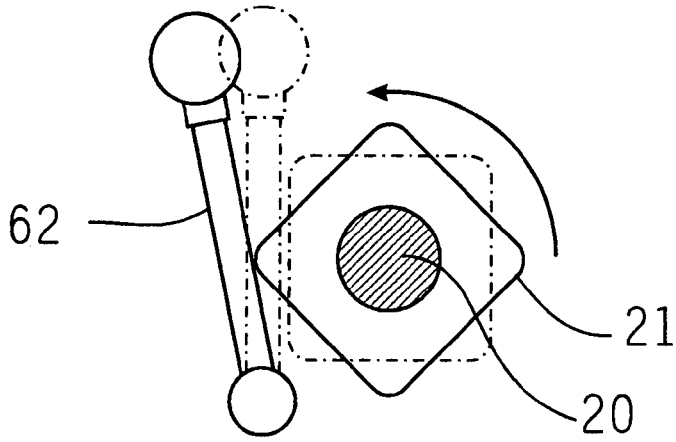
FIG. 17 is a view similar to FIG. 16 where the lever is operating.

Referring to FIGS. 15 to 17 an elevator evacuation apparatus in accordance with a third preferred embodiment of the invention is shown. The characteristics of the third preferred embodiment are detailed below. A disc brake comprises a disc 60 between the drive sheave 13 and the motor 11, brake pads 61 at one ends of the disc 60, and a lever 62 operatively connected to the brake pads 61 and spaced from the first cam 21 by a gap. The brake pads 61 actuate to stop the rotation of the drive sheave 13 in case of emergency (e.g., due to power outage). Also, the car 10 does not stop at the correct floor location. Hence, a person trapped in the car 10 can reach his or her hand out of the window 101 to hold and pull down the emergency cable 14. As a result, the emergency pulley 40 turns and thus both the first shaft 20 and the first gear 30 turn. At the same time, the first cam 21 turns to release the brake pads 61 by pivoting the lever 62 counterclockwise (see arrow of FIG 17) in one time and actuate the brake pads 61 by disengaging with the lever 62 in an immediately next time. That is, the brake pads 61 release and actuate intermittently.

Also, the second gear 31 turns in a direction opposite that of the first gear 30 and the second cam 33 turns the same direction as the second gear 31. As a result, the second cam 33 intermittently turns the drive sheave 13. Therefore, the car 10, connected to one ends of the hoist ropes, lowers by pulling down the hoist ropes run thrbugh rope grooves of the drive sheave 13 and by causing weight of the counterweight to be unequal to that of the stopped car 10 (i.e., the car 10 is in its unbalanced state). The trapped person can stop the pulling when the car 10 has arrived the correct floor. Eventually, person(s) trapped in the car 10 can evacuate safely.

While the invention herein disclosed has been described by means of specific embodiments, numerous modifications and variations could be made thereto by those skilled in the art without departing from the scope and spirit of the invention set forth in the claims.

What is claimed is:

1. An emergency evacuation apparatus for an elevator which has a car with a window, a counterweight, hoist ropes having one end connected to the car and the other end connected to the counterweight, a drive sheave, a brake, and a motor, the evacuation apparatus comprising:

a brake operating device connected to the brake;

a distal emergency pulley with a grooved rim, mounted on a first shaft which has a fixed axis of rotation, separate from the drive sheave;

an intermittent brake release mechanism further comprising a first cam disposed to be engageable with the brake operating device, a first gear, and a first shaft coaxially rotating the emergency pulley, the first gear, and the first cam;

an auxiliary drive, further comprising a second gear engaged with the first gear, a second cam spaced from the second gear and engaged with a rim of the drive sheave, and a second shaft fixed to the second cam and the second gear, coaxially rotating the second cam and the second gear; and an emergency cable running through the grooved rim of the emergency pulley, passed down, and disposed externally of the window, causing the emergency pulley to turn when the cable is pulled;

wherein in response to a stop of the elevator in case of emergency, when the brake actuates to stop a rotation of the drive sheave, a person trapped in the car is able to reach his or her hand out of the window to pull down the emergency cable to turn the emergency pulley which turns the first cam and the second cam respectively; the continuous turning of the first cam intermittently releases and actuates the brake by causing the first cam to act on the brake operating device; and the releasing of the brake allows the second cam to turn the drive sheave to incrementally lower the car to a correct floor.

2. The emergency evacuation apparatus for an elevator which has a car with a window, a counterweight, hoist ropes having one end connected to the car and the other end connected to the counterweight, a drive sheave, a brake, and a motor, as claimed in claim 1, wherein the brake operating device has two opposite plungers operatively connected to the brake.

3. The emergency evacuation apparatus for an elevator which has a car with a window, a counterweight, hoist ropes having one end connected to the car and the other end connected to the counterweight, a drive sheave, a brake, and a motor, as claimed in claim 1, wherein the second shaft of the auxiliary drive is parallel to the first shaft of the intermittent brake release mechanism.

4. The emergency evacuation apparatus for an elevator which has a car with a window, a counterweight, hoist ropes having one end connected to the car and the other end connected to the counterweight, a drive sheave, a brake, and a motor, as claimed in claim 3, wherein the first gear is disposed between the first cam and the emergency pulley.

5. An emergency evacuation apparatus for an elevator which has a car with a window, a counterweight, hoist ropes having one ends connected to the car and the other ends connected to the counterweight, a drive sheave, a brake, and a motor, the evacuation apparatus comprising:

a brake operating device having a spring biased rod operatively connected to the brake;

a distal emergency pulley with a grooved rim, mounted on a first shaft which has a fixed axis of rotation separate from the drive sheave;

an intermittent brake release mechanism, further comprising a first cam disposed in close proximity to the rod, a first gear disposed between the first cam and the emergency pulley, and first shaft coaxially rotating the emergency pulley, the first gear, and the first cam;

an auxiliary drive, further comprising a second gear, an idler gear engaged with the second gear and the first gear a second cam spaced from the second gear and engaged with a rim of the drive sheave, and a second shaft fixed to the second cam and the second gear, coaxially rotating the second cam and the second gear; and an emergency cable running through the grooved rim of the emergency pulley, passed down, and disposed externally of the window, causing the emergency pulley to turn when the cable is pulled;

wherein in response to a stop of the elevator in case of emergency, when the brake actuates to stop a rotation of the drive sheave, a person trapped in the car is able to reach his or her hand out of the window to pull down the emergency cable to turn the emergency pulley which turns the first cam and the second cam respectively; the continuous turning of the first cam intermittently releases and actuates the brake by acting on the plungers; and the releasing of the brake allows the second cam to turn the drive sheave to lower the car to a correct floor.

6. An emergency evacuation apparatus for an elevator including a car having a window, a counterweight, hoist ropes having one ends connected to the car and the other ends connected to the counterweight, a drive sheave, a brake, and a motor, comprising:

a brake operating device having a lever operatively connected to the brake;

a distal emergency pulley with a grooved rim, mounted on a first shaft that has a fixed axis of rotation separate from the drive sheave;

an intermittent brake release mechanism, further comprising a first cam disposed in close proximity to the lever, a first gear disposed between the first cam and the emergency pulley and a first shaft coaxially rotating the emergency pulley, the first gear, and the first cam;

an auxiliary drive, further comprising a second gear engaged with the first gear, a second cam spaced from the second gear and engaged with a rim of the drive sheave, and a second shaft fixed to the second cam and the second gear, coaxially rotating the second cam and the second gear; and an emergency cable running through the grooved rim of the emergency pulley, passed down, and disposed externally of the window, causing the emergency pulley to turn when the cable is pulled;

wherein in response to a stop of the elevator in case of emergency, when the brake actuates to stop a rotation of the drive sheave, a person trapped in the car is able to reach his or her hand out of the window to pull down the emergency cable to turn the emergency pulley which turns the first cam and the second cam respectively; the continuous turning of the first cam intermittently releases the brake by causing the first cam to pivot the lever in first direction in one time and actuates the brake by pivoting the lever in second direction opposing the first direction; and the releasing of the brake allows the second cam to turn the drive sheave to lower the car to a correct floor.

* * * * *